United States Patent [19]

Cuminale et al.

[11] 4,442,942

[45] Apr. 17, 1984

[54] CARDED MERCHANDISE DISPLAY

[75] Inventors: Raymond J. Cuminale, New York, N.Y.; Stanley W. Otto, Platte City; Jerry L. Knipp, Grand View; Bernard P. Seibolt, Kansas City, all of Mo.; Fred E. Yarkoni, Paramus, N.J.

[73] Assignee: Hallmark Cards, Inc., Kansas City, Mo.

[21] Appl. No.: 358,101

[22] Filed: Mar. 15, 1982

[51] Int. Cl.[3] ..... A47F 7/02

[52] U.S. Cl. ..... 211/163; 211/13; 211/4; 211/1.5

[58] Field of Search ..... 211/1.5, 4, 163, 131, 211/1, 95, 7, 162; 312/252, 135, 202; 206/566, 486

[56] References Cited

U.S. PATENT DOCUMENTS

| | | | |
|---|---|---|---|
| 164,114 | 6/1875 | Van Arsdale . | |
| 646,388 | 8/1900 | Moore . | |
| 1,134,908 | 4/1915 | Romsos | 312/135 |
| 1,950,165 | 11/1932 | De Lorenzo | 211/4 |
| 2,926,788 | 8/1960 | Jacobson | 211/4 |
| 3,181,706 | 5/1965 | Mandel | 211/163 |
| 3,195,736 | 7/1965 | Bomar, Jr. | 211/163 |
| 3,319,800 | 5/1967 | Bowles | 211/163 |
| 3,399,781 | 9/1968 | Nalbondian | 312/135 X |
| 3,565,260 | 2/1971 | Stewart | 211/4 |
| 3,570,676 | 3/1971 | Crosslen | 211/4 |
| 3,583,568 | 6/1971 | Crosslen | 211/8 |
| 3,661,273 | 5/1972 | Crosslen | 211/169 |
| 3,674,156 | 7/1972 | Krebs | 211/4 |
| 3,785,499 | 1/1974 | Gidye | 211/4 |
| 3,786,927 | 1/1974 | Manheim | 211/4 |
| 3,801,055 | 4/1974 | Stenger | 248/176 |
| 3,915,306 | 10/1975 | Desisto et al. | 211/4 |
| 3,924,749 | 12/1975 | Weston | 211/4 |
| 3,934,727 | 1/1976 | Brefka | 211/7 |
| 3,938,665 | 2/1976 | Rumble | 211/4 |
| 3,960,273 | 6/1976 | Weston | 211/4 |
| 3,982,633 | 9/1976 | Pennington | 211/4 |
| 4,026,417 | 5/1977 | Streim et al. | 211/163 |
| 4,073,557 | 2/1978 | Crosslen | 312/284 |
| 4,108,515 | 8/1978 | Johnson | 312/119 |
| 4,155,457 | 5/1979 | Wilbert | 211/4 |
| 4,281,469 | 8/1981 | Feibelman | 206/566 X |
| 4,322,007 | 3/1982 | Feibelman | 211/13 X |
| 4,391,375 | 7/1983 | Joyce | 211/13 |

*Primary Examiner*—Ramon S. Britts
*Assistant Examiner*—Robert W. Gibson, Jr.
*Attorney, Agent, or Firm*—Stephen P. Gilbert

[57] ABSTRACT

Anti-theft apparatus and method for displaying merchandise cards containing merchandise such as jewelry are disclosed. The apparatus in its locked position substantially hinders unauthorized removal of the cards, whereas in the unlocked position, the cards may be removed easily. Fresh cards may be added to the display unit whether the device is in its locked or unlocked position.

10 Claims, 13 Drawing Figures

50
42
22
48
51
66
64
90
65
68
90
5
78
56
54
52
74
58
28
26
70
72
76
80
24
40
38
62
60
32

CARDED MERCHANDISE DISPLAY

BACKGROUND OF THE INVENTION

Shoplifting of merchandise displayed in stores is a continuing problem. Shoplifting of jewelry is particularly hard to detect because of the small size of the jewelry. One obvious solution is to put the jewelry in a locked showcase and to have a salesperson unlock the showcase and supervise shoppers' inspection of the merchandise. However, that has been found to reduce sales and it increases the number of salespersons required.

Other solutions to the problem involve firmly mounting jewelry on cards and displaying the cards on units that lock the cards in place but allow shoppers to inspect the jewelry. The units are unlocked to release the cards. Such devices are shown in U.S. Pat. Nos. 4,026,417 and 4,155,457. For other kinds of merchandise, display devices having rotating members that in one position allow removal of merchandise and in a second position prevent removal are shown in U.S. Pat. Nos. 646,388, 3,674,156, 3,924,749, 3,938,665, and 3,960,273. U.S. Pat. No. 164,114 discloses a paint exhibitor having a plurality of vertically rotatable panels disposed between rigid pillars.

None of those display units allows addition of fresh merchandise when the unit is in the locked position; all must first be unlocked. Each of the two jewelry display units requires substantial space to display a given amount of merchandise. If a unit is on top of a showcase, shoppers are hindered in viewing the goods in the showcase. Furthermore, in those units the means used to restrain the jewelry display cards are clearly visible, which is undesirable for aesthetic and psychological reasons.

SUMMARY OF THE INVENTION

A new display fixture for carded merchandise that overcomes all of the above drawbacks has now been developed. The device is aesthetically pleasing, allows a substantial amount of merchandise to be displayed within a relatively small area on top of a showcase, does not have to be unlocked to add fresh merchandise, and presents a substantial impediment to the theft of the carded merchandise. Other advantages will be apparent from the following description.

The apparatus for displaying merchandise utilizes display cards generally "C"-shaped in cross-section having upper and bottom channels, one channel being wider than the other channel. Broadly, the apparatus comprises:

(a) a vertical central upright having at least two faces, each face having at least one pair of upper and lower rungs of different widths that can mesh, respectively, with the upper and lower channels of a display card so that the card can be removed easily from the rungs only by sliding it from the rungs in a direction essentially parallel to the length of the rungs;

(b) a plurality of vertical rotatably mounted side uprights having at least two faces, each face having at least one pair of upper and lower rungs of different widths that can mesh, respectively, with the upper and lower channels of a display card so that the card can be removed easily from the rungs only by sliding it from the rungs in a direction essentially parallel to the length of the rungs; and (c) means for rotating each side upright from a first position to a second position, the vertical sides of the side uprights being sufficiently close to the vertical sides of the central upright when each side upright is in its first position so that display cards cannot be slid free from the rungs of any face of any upright and the vertical sides of the side uprights being sufficiently distant from the vertical sides of the central upright when each side upright is in its second position so that display cards can be slid free from the rungs of any face of any upright.

In a preferred embodiment, the apparatus comprises:

(a) a vertical rotatably mounted central upright essentially square in horizontal cross-section having four faces and four vertical corners, each face having at least one pair of upper and lower rungs of different widths that can mesh, respectively, with the upper and lower channels of a display card so that the card can be removed easily from the rungs only by sliding it free from the rungs in a direction essentially parallel to the length of the rungs;

(b) four vertical rotatably mounted side uprights each having two essentially parallel faces and first and second vertical sides, each face having at least one pair of rungs of different widths that can mesh, respectively, with the upper and lower channels of a display card so that the card can be removed easily from the rungs only by sliding it from the rungs in a direction essentially parallel to the length of the rungs, each first vertical side having a stop member to prevent display cards from being slid past the stop member off the rungs of the side upright;

(c) means for rotating the center upright and the four side uprights each from its first position to its second position, the second vertical side of each side upright being sufficiently close to a different one of the four vertical corners of the central upright when all five uprights are in their first positions so that display cards cannot be slid free from the rungs of any face of any upright and the second vertical sides of the side uprights being sufficiently distant from the vertical corners of the central upright when all five uprights are in their second positions so that display cards can be slid free from the rungs of any face of any upright; and (d) means for locking the five uprights in their first positions to hinder unauthorized removal of the display cards from the apparatus.

DETAILED DESCRIPTION OF THE DRAWINGS

To facilitate further description of the present invention and its advantages over the prior art, the following drawings are provided in which:

FIG. 6 is a cross-sectional view of the top of the device taken along line 6—6 of FIG. 5;

FIG. 13 shows the removal of a display card from the prior art device.

It should be understood that FIGS. 1 to 9 are provided for illustrative purposes only and should not be construed to limit the scope of the invention.

DETAILED DESCRIPTION OF THE INVENTION

Figure 1:
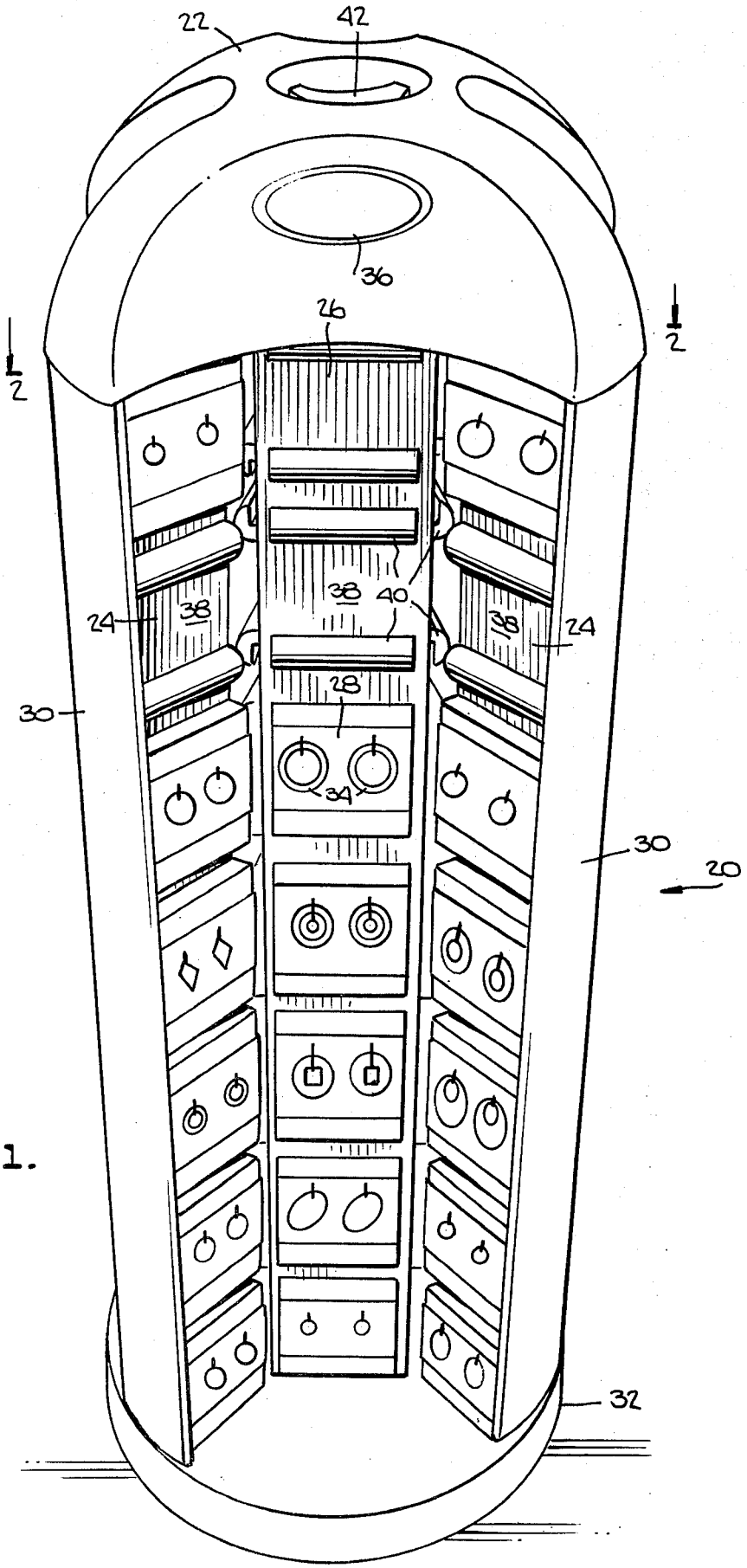
FIG. 1 is an elevational perspective view of the preferred carded merchandise display unit in accordance with the present invention.

FIG. 1 is a perspective elevational view of preferred carded merchandise display 20. The device has three main sections: dome 22, a middle portion comprising center upright 26 and four side uprights 24 (only two of which are visible), and a base comprising upper base member 32 and lower base member 60 (not visible in this view; see FIG. 4). Area 36 is provided for displaying retail information.

Figure 2:
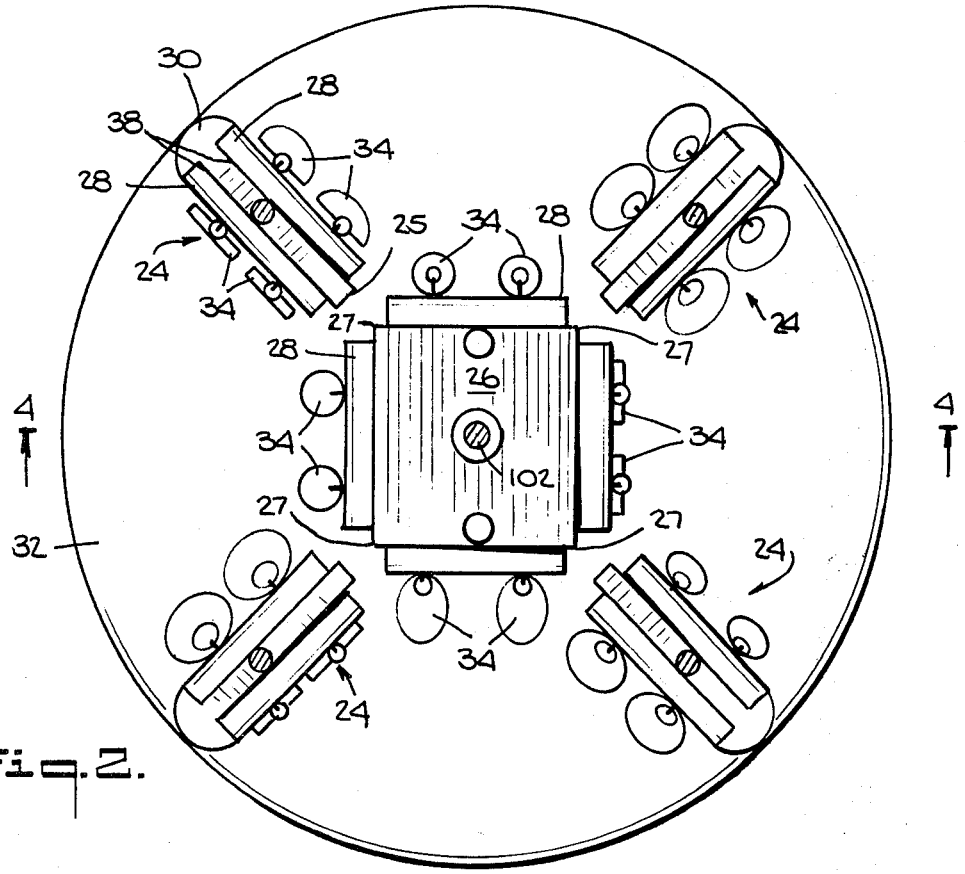
FIG. 2 is a cross-sectional view taken along line 2—2 of FIG. 1.

Referring to FIGS. 1 and 2, center upright 26 is essentially square in horizontal cross-section and, therefore, has four vertical faces (or ladders) 38 and four vertical corners 27. (For simplicity, in FIG. 2 and in other drawings only one of the four side uprights has all the reference numerals shown. It should be understood that the four side uprights are identical in construction and operation.) Side uprights 24 are roughly rectangular in cross-section and each has two essentially parallel vertical faces 38 and two vertical sides, outer side (or stop member) 30 and inner side 25.

Jewelry 34 (in this case, pairs of earrings) is tightly affixed in any convenient manner to merchandise display cards 28. Each of the merchandise display cards 28 is mounted on a pair of rungs 40 on ladders 38.

As will be described below, display cards 28 may easily be snapped on to rungs 40 but the display cards cannot be removed easily from the rungs except by sliding the cards from the rungs in a direction parallel to the face of the upright and, more specifically, parallel to the length of the rungs. Accordingly, none of the display cards 28 in FIGS. 1 and 2 can be removed easily from display unit 20, for the following reasons.

The display cards on the four side uprights cannot be slid away from axial center 102 of the device because of enlarged vertical outer sides (or vertical stop members) 30. The display cards on the side uprights cannot be slid towards axial center 102 sufficiently to remove the cards from the rungs because corners 27 of center upright 26 are too close to inner vertical sides 25 of the side uprights. For the same reason, display cards 28 cannot be slid free from the rungs of any of the four faces of center upright 26.

Figure 3:
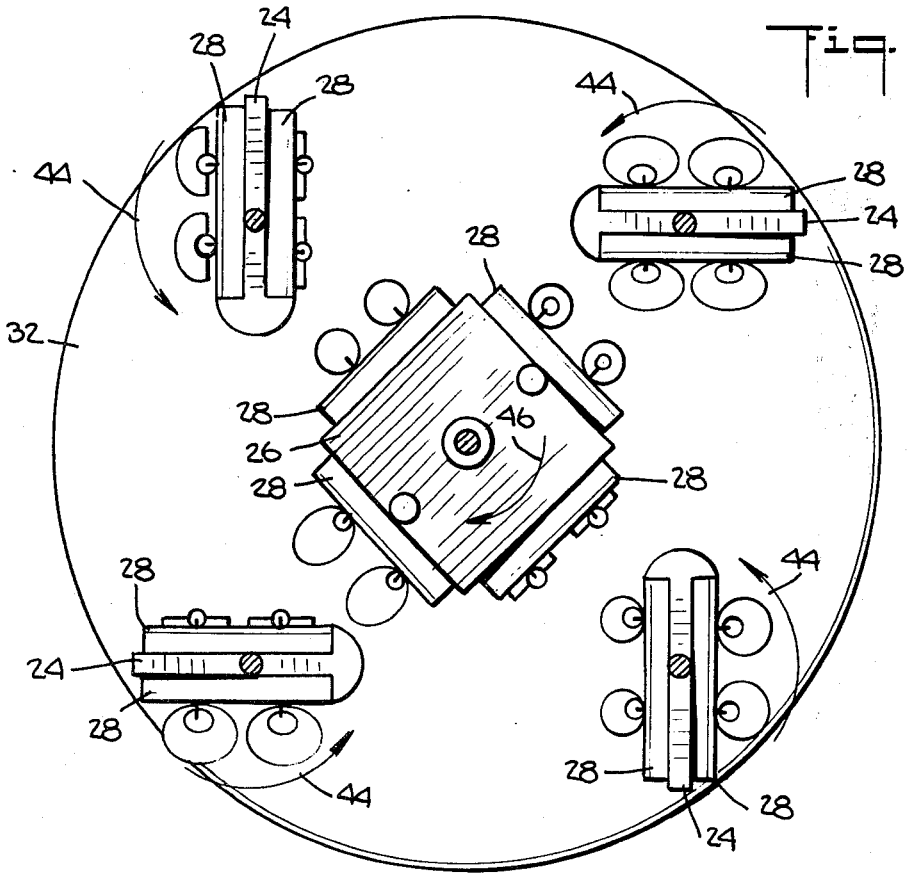
FIG. 3 is a view similar to that of FIG. 2 but showing the five uprights of the device rotated to permit removal (by sliding) of the display cards mounted thereon.

FIG. 3 shows the position of the five uprights after they have been rotated as indicated by arrows 44 and 46 to permit display cards 28 to be slid free from any of the twelve ladders on the five uprights.

Figure 4:
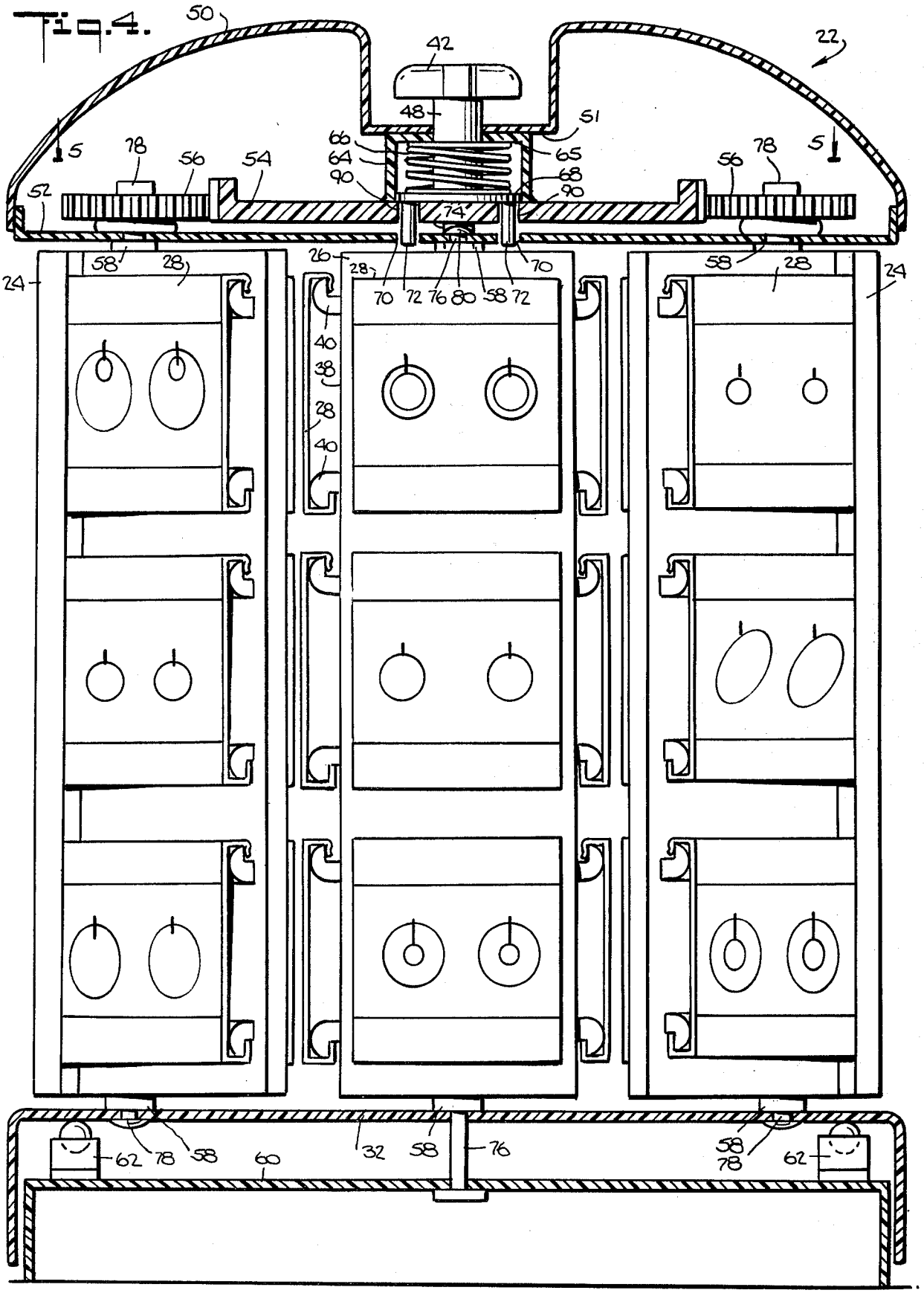
FIG. 4 is a cross-sectional elevational view of the device taken along line 4—4 of FIG. 2 (but showing the central upright in full frontal view)

FIGS. 4 to 8 illustrate operation of the mechanism for rotating the five uprights. Referring to FIG. 4, each side upright 24 is rotatably mounted on its own shaft 78. Center upright 26 is rotatably mounted on shaft 76, having rounded top portion 80. Each of shafts 76 and 78 passes through upper base member 32 and lower dome portion 52, and spacers 58 maintain the desired spacing between the upper and lower ends of the five uprights and members 32 and 52. Center shaft 76 also passes through lower base member 60, which member rotatably supports upper base member 32 by means of ball-bearing assembly 62.

Dome 22 comprises upper dome portion 50, having a center recess in which knob 42 is located, and lower dome portion 52. Slave gear 56 is attached to the top of each shaft 78 of side uprights 24. Master gear 54 meshes with each of the four slave gears 56 and is connected to knob 42 by shaft 48 in the following manner.

Shaft 48 connects knob 42 directly to plate 68, which plate is free to move vertically within cylindrical box 64. Locking pins 72 are affixed to the bottom of plate 68 and pass through holes 90 in master gear 54 and holes 70 in lower dome portion 52. Plate 68 is biased away from top 65 of box 64 by spring 66. If knob 42 is pulled upwards sufficiently to remove pins 72 from holes 70 but not so far as to remove them from holes 90 (FIG. 7), when knob 42 is rotated, pins 72 will immediately hit the sides of holes 90 because of the close fit of pins 72 in holes 90 and force master gear 54 to rotate in unison with knob 42.

Figure 7:
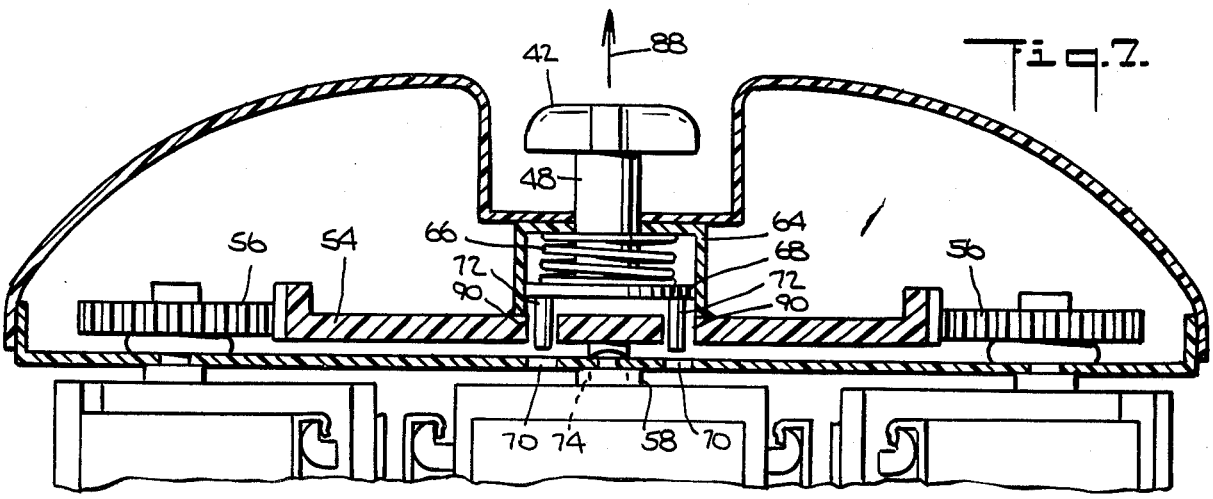
FIG. 7 is a view of the device similar to that of FIG. 6 but snowing the device unlocked to permit rotation of the five uprights.

Arrow 88 in FIG. 7 indicates knob 42 being pulled upwards, thereby pulling up shaft 48, plate 68, and pins 72 and compressing spring 66. The height of spring 66 in its compressed state and the length of pins 72 prevents pins 72 from leaving holes 90 when knob 42 is pulled upwards. Rotation of master gear 54 causes each of the four slave gears 56 to rotate, thereby rotating each of the four side uprights 24 (compare FIGS. 5 and 8).

Referring to FIG. 6, rotary motion of knob 42 is transmitted to center upright 26 by pins 74, each of which is affixed at one end to master gear 54 and at the other end to the top of center upright 26. Cylindrical box 64 is affixed to the top of master gear 54 and top portion 65 of box 64 is free to rotate with respect to flat central portion 51 on upper dome portion 50.

Figure 5:
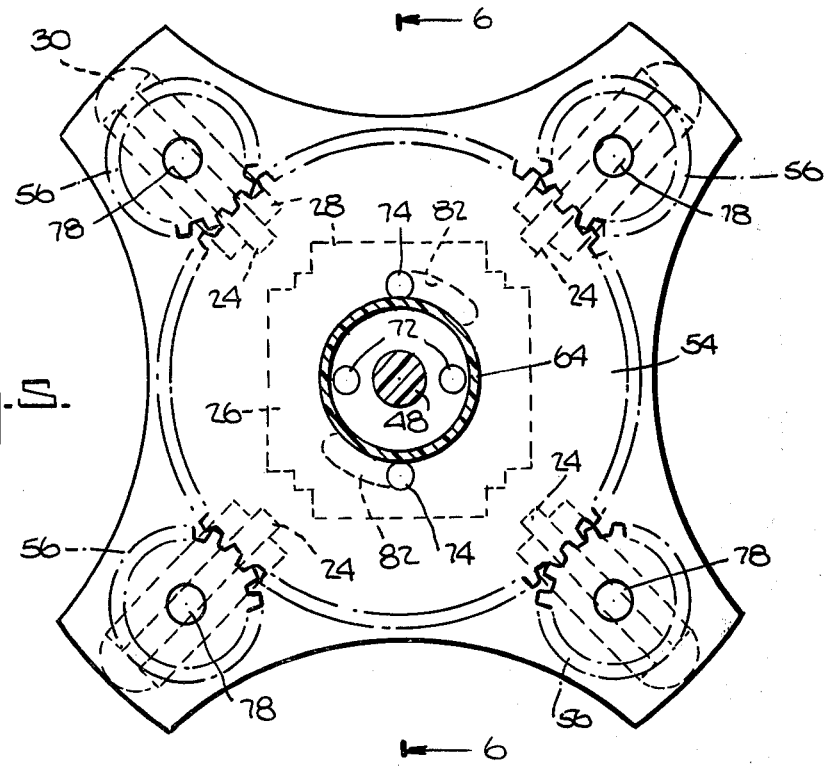
FIG. 5 is a cross-sectional view taken along line 5—5 of FIG. 4.
Figure 8:
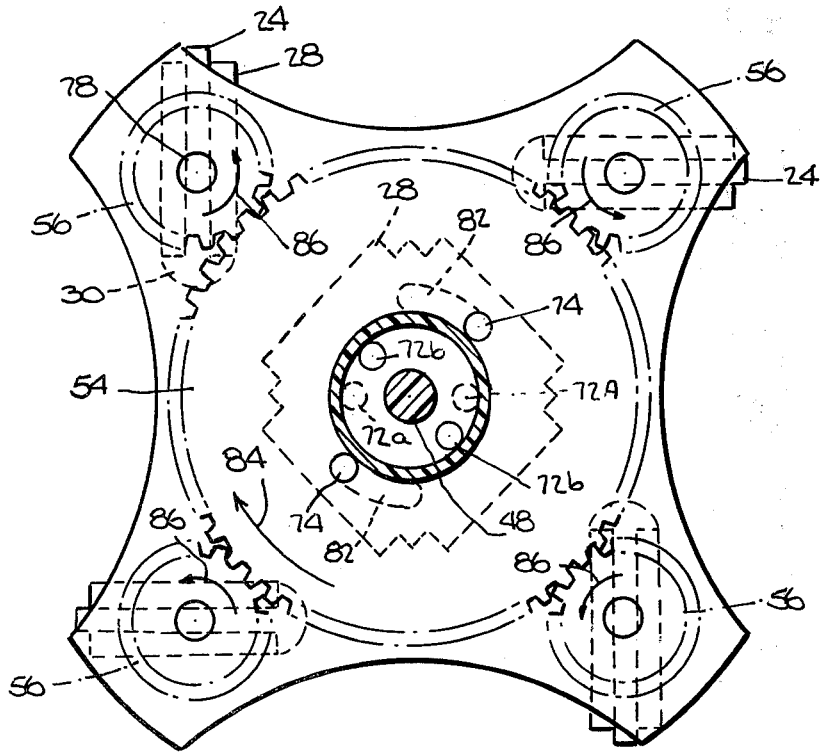
FIG. 8 is a view of the device similar to that of FIG. 5 but with the five uprights rotated to permit removal of the merchandise display cards.
Figure 8:
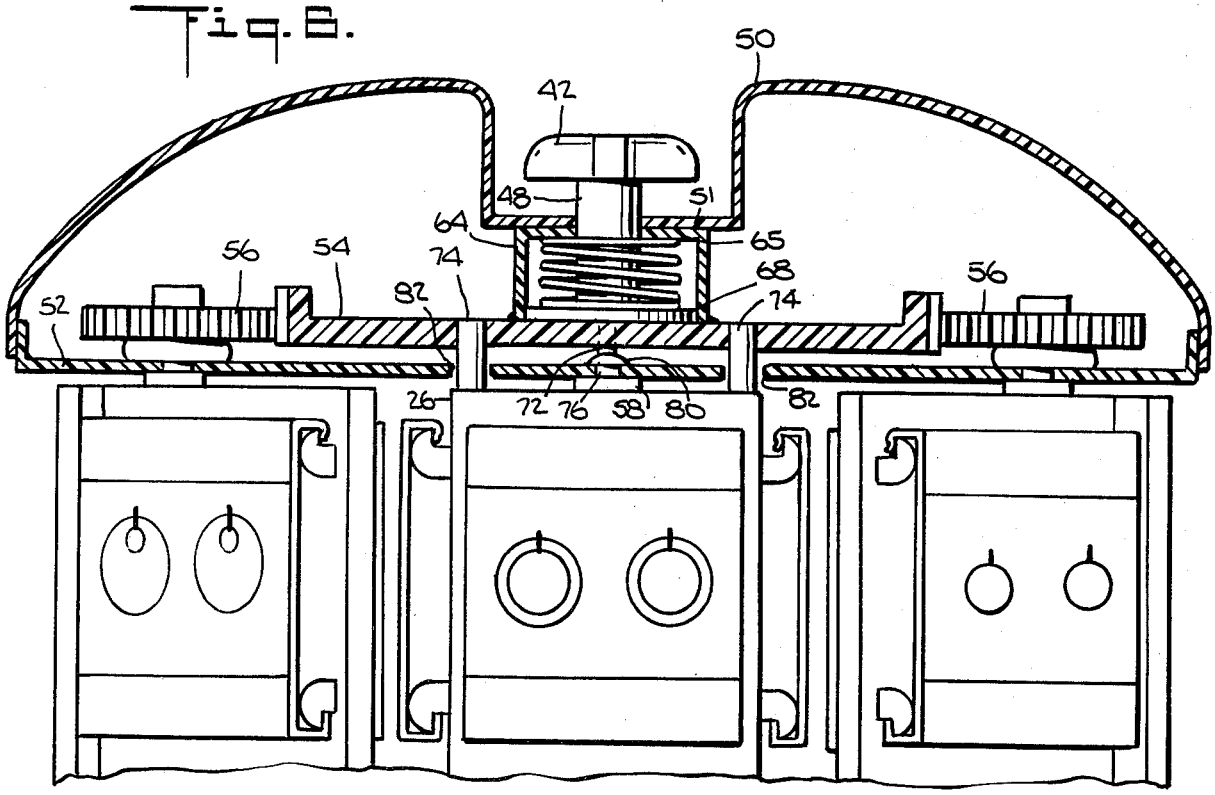

Pins 74 also act as travel-limiting pins because they ride in arcuate slots 82 in lower dome portion 52 (FIGS. 5, 6, and 8). The length of slots 82 determines the amount of travel permitted pins 74 and, thus, the amount of rotation permitted gears 54 and 56 and, in turn, the amount of rotation permitted uprights 24 and 26.

FIG. 8 shows the effect of rotating knob 42 clockwise. Master gear 54 has been rotated clockwise, as indicated by arrow 84, and the four slave gears 56 have been rotated counter-clockwise, as indicated by arrows 86. Locking pins 72 are shown in phantom line in their locked positions (72*a*) and in their positions following rotation (72*b*). Travel-limiting pins 74 are shown moved to the other ends of slots 82. In FIG. 8, cards 28 may be slid free from any of the rungs because there are no obstructions to block such movement.

Figure 9:
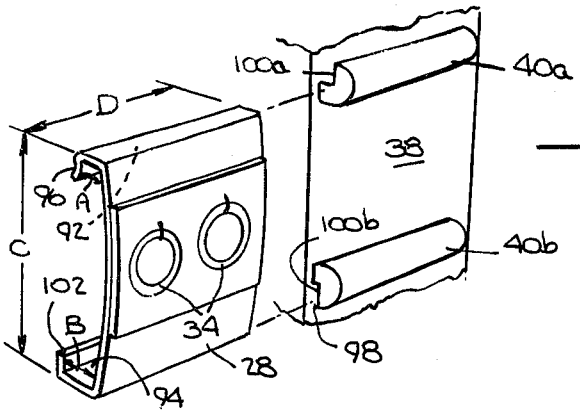
FIG. 9 shows a merchandise display card slid from the rungs of a ladder on one of the uprights of the device.
Figure 10:
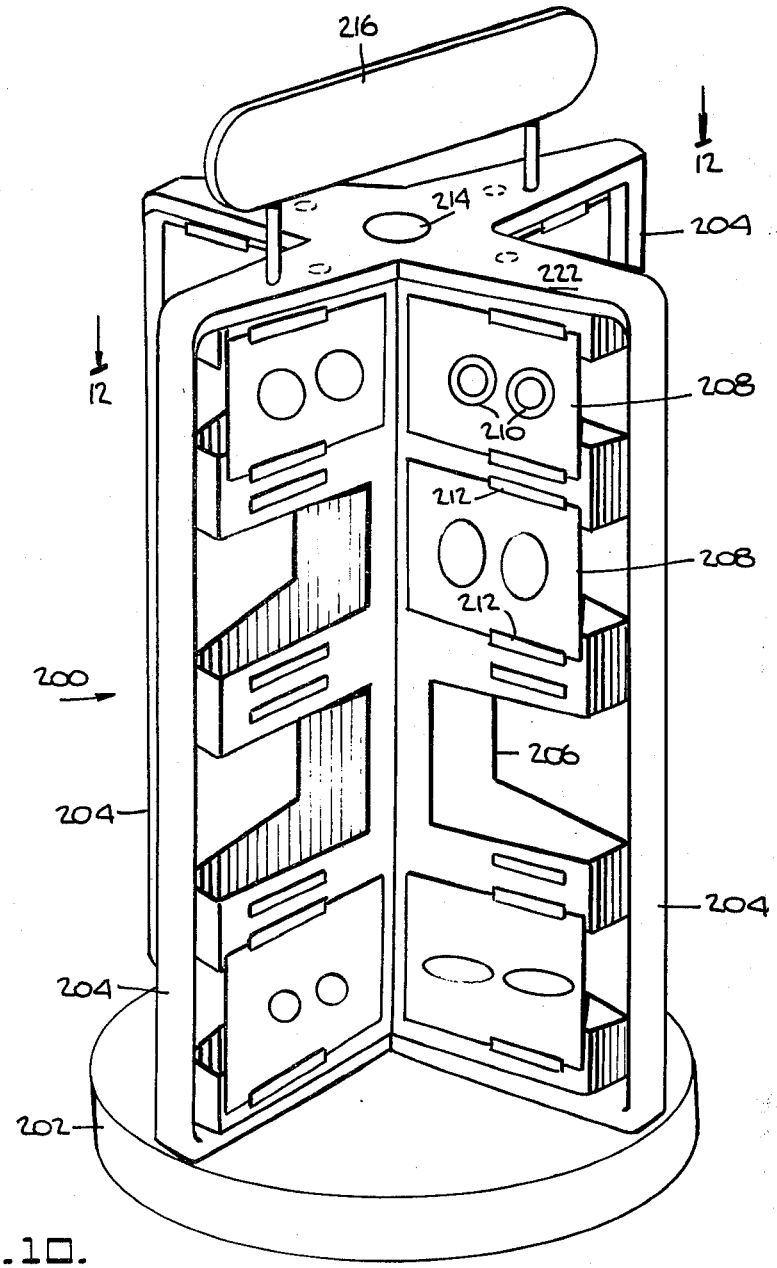
Fig. 10. Prior Art
FIG. 10 is a perspective elevational view of a prior art display tower.

In FIG. 9, preferred merchandise display card 28 has been slid in a direction essentially parallel to the length of rungs 40 sufficiently so as to remove the card from the rungs. The configuration of the card, its material of construction, and the configuration of the two rungs make it extremely difficult to remove the card by pulling it from the rungs in a direction substantially perpendicular to ladder 38. The preferred card is made by profile extruding cellulose acetate (other extrusion grade materials having the required physical properties, particularly strength and resilience, may be used), is approximately 25 thousandths of an inch thick, and has the following dimensions (tolerances given in parentheses):

| Dimension Line | Dimension (Inches) |
|---|---|
| A | 3/16 (±.010) |
| B | 7/32 (±.010) |
| C | 2⅜ (±.025) |
| D | 1 15/16 |

An important feature of the present invention is that inner gripping surface **100*b* of lower rung 40*b* is closer to the surface of ladder 38 then is inner face 100*a* of upper rung 40*a*. That is, lower rung 40*b* is wider than upper rung 40*a* because the rounded faces of the two rungs are the same distance from the surface of ladder 38. Consistent with that, upper channel 92 of display card 28 is narrower (Dimension A) than lower channel 94** (Dimension B).

This configuration of the channels and rungs prevents inadvertent upside-down placement of the card on the rungs. If a salesperson attempts to place the card upside-down on the rungs, the salesperson will quickly discover that upper channel 92 is not wide enough to fit over rung **40*b*, that is, lip 96 of upper channel 92 is not far enough from the major face of display card 28 to snap around corner 98 of lower rung 40*b***. (Obviously, the upper channel and rung could be the wider ones and still be within the present invention.)

The dimensions of card 28 and rungs **40*a* and *b*** must be carefully chosen so that the card fits snugly on the rungs when slid or snapped on. Any set of dimensions that result in the desired interaction of the card and device as set forth herein may be used. Preferred card dimensions and tolerances are given above. Dimensions and tolerances of the rungs will be obvious to one skilled in the art.

In the preferred card of FIG. 9, lip 96 of upper channel 92 is curved. That provides a friction fit of the upper channel on upper rung **40*a* and helps prevent display card 28 from sliding off rungs 40*a* and *b* if the upright is rotated too quickly. The precise curvature of lip 96** is not critical and any curvature resulting in the desired friction fit may be used.

Because of the flexibility and resilience of the display card and its geometry and that of the rungs, fresh cards may be placed on the device while in its locked position. That saves time because the device need not be unlocked and relocked every time fresh merchandise is added.

Referring to FIG. 9, to add new cards while the device is in the locked position (as in FIG. 1), lip 96 of upper channel 92 is hooked onto upper rung **40*a* in the space between gripping surface 100*a* and face 38. The bottom of card 28 is then rotated downwards, until lip 102 contacts the rounded surface of lower rung 40*b*. Continued rotation bends lip 102 inward temporarily towards the major face of card 28. Further rotation allows the lip to snap upright so as to lie between lower gripping surface 100*b* and face 38. Lip 102 is angled outward very slightly, i.e., at an angle slightly more than 90° with respect to the bottom of channel 94, to facilitate snapping the card onto lower rung 98**.

Alternatively, to add fresh merchandise, the device may be unlocked, the uprights rotated, fresh cards slid onto empty rungs, and the uprights rotated back and locked, but that time-consuming procedure is obviously not necessary.

Figure 11:
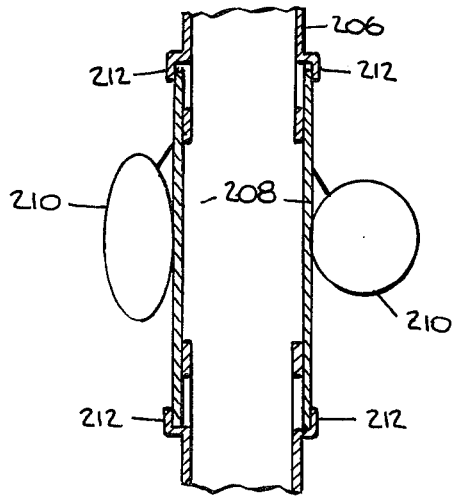
Fig. 11. Prior Art
FIG. 11 is an enlarged cross-sectional detail view showing how the prior art merchandise display card is attached to the prior art device.

FIGS. 10 to 13 depict a prior art device. Display tower 200 has three main sections: base 202, frame 204 with top section 222, and rotatable center portion 206. Area 216 is provided for display information. Display cards 208 having merchandise 210 mounted thereon are flat, that is, they do not have upper or lower channels (FIG. 11). Display cards 208 slide between tabs 212.

Figure 12:
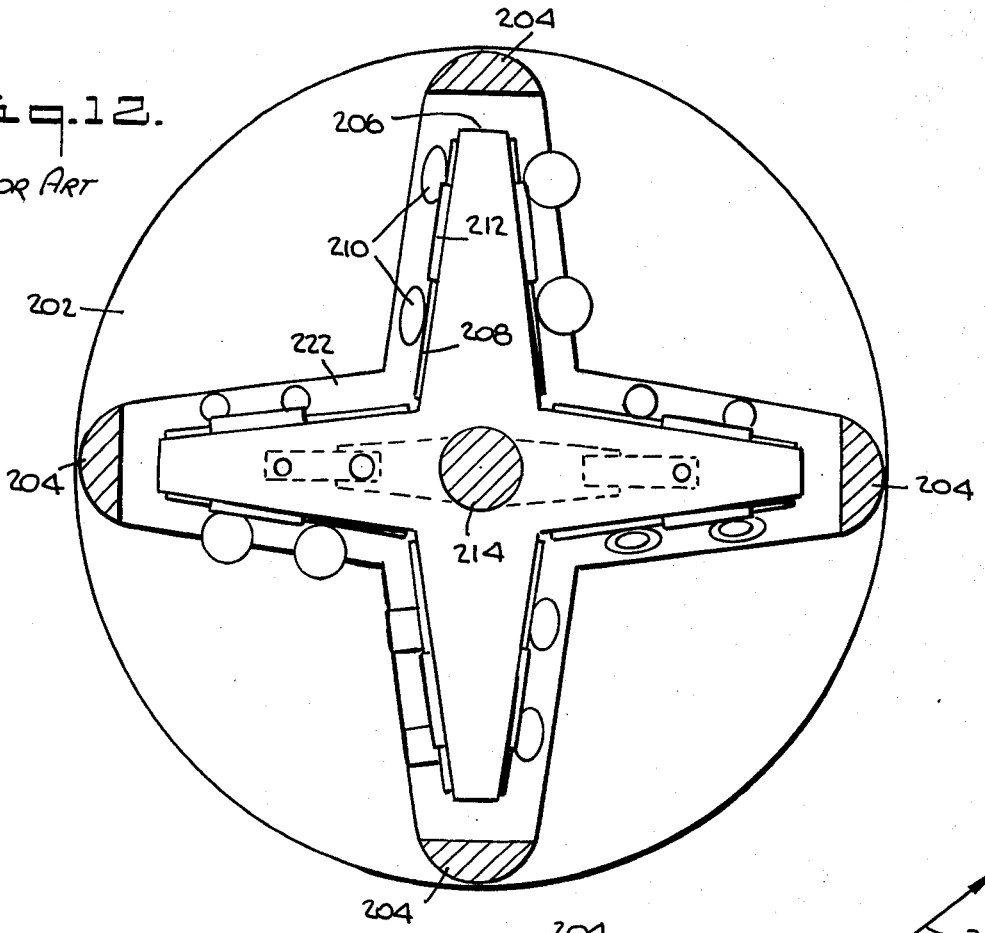
Fig. 12. PRIOR ART
FIG. 12 is a view of the prior art device taken along line 12—12 of FIG. 10.
Figure 18:
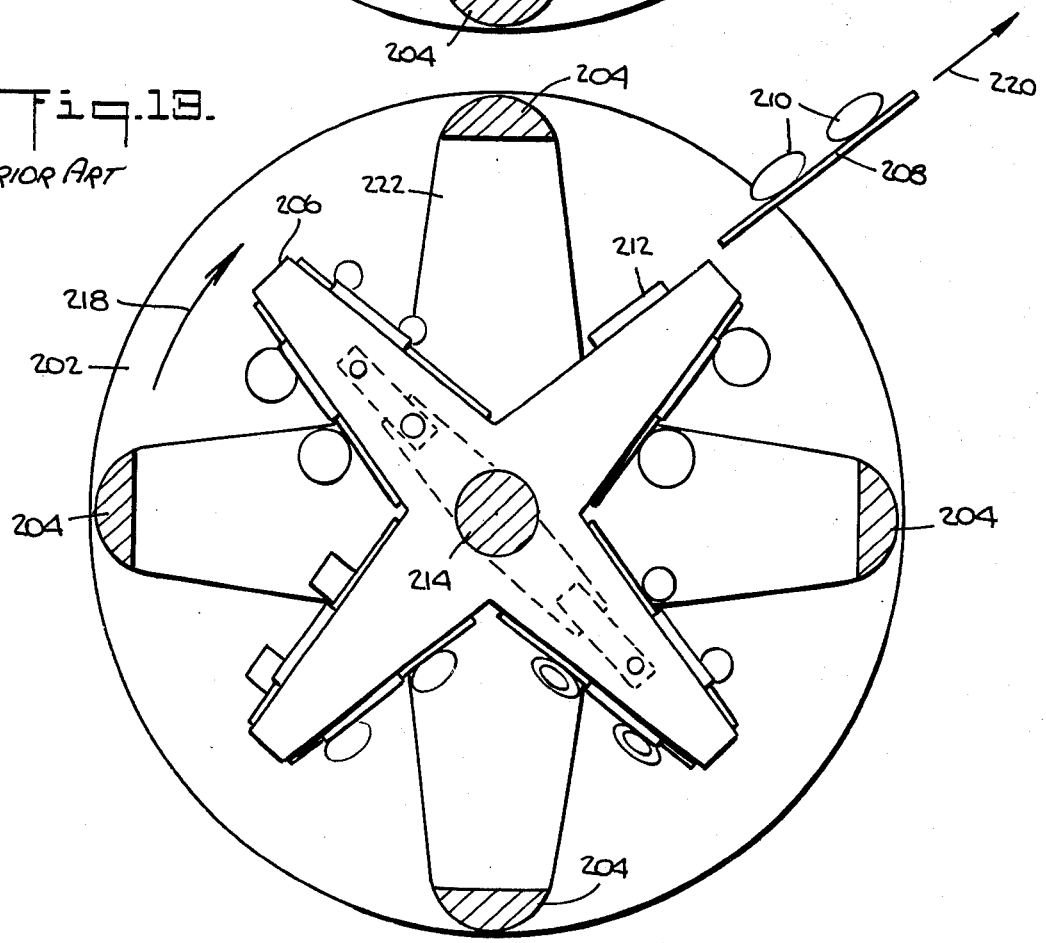
Fig. 18. PRIOR ART

In FIG. 12, rotatable portion 206 is seen to be roughly "X"-shaped in cross-section and FIG. 13 shows that it rotates as a unit within frame 204. In FIG. 13, arrow 218 indicates rotation of rotatable portion 206 around shaft 214 to permit card 208 to be slid from member 206 in the direction indicated by arrow 220.

Prior art device 200 has several disadvantages. First, it was found that cards 208 could be easily removed from the device even when in the locked position. Second, fresh display cards could not be placed on the device unless rotatable member 206 was moved from the locked position of FIGS. 10 and 12. Third, substantially less merchandise could be displayed for a given base area as compared to the far greater amounts when using devices of the present invention (e.g., the device of FIGS. 1 to 9).

Variations and modifications in the present invention will be apparent to one skilled in the art and the claims are intended to cover all variations and modifications that fall within the true spirit and scope of the invention. For example, depending on the size of the uprights and the size of the entire apparatus, fewer or greater than four side uprights could be used. The cross-section of the central upright could be that of an equilateral triangle and three side uprights used.

We claim:

1. Apparatus for displaying merchandise mounted on display cards generally "C"-shaped in cross-section having an upper channel and a bottom channel, one channel being wider than the other channel, said apparatus comprising:

(a) a vertical central upright having at least two faces, each face having at least one pair of upper and lower rungs of different widths that can mesh, respectively, with the upper and lower channels of a display card so that the card can be removed easily from the rungs only by sliding it from the rungs in a direction essentially parallel to the length of the rungs;

(b) a plurality of vertical rotatably mounted side uprights having at least two faces, each face having at least one pair of upper and lower rungs of different widths that can mesh, respectively, with the upper and lower channels of a display card so that the card can be removed easily from the rungs only by sliding it from the rungs in a direction essentially parallel to the length of the rungs; and (c) means for rotating each side upright from a first position to a second position, the vertical sides of the side uprights being sufficiently close to the vertical sides of the central upright when each side upright is in its first position so that display cards cannot be slid free from the rungs of any face of any upright and the vertical sides of the side uprights being sufficiently distant from the vertical sides of the central upright when each side upright is in its second position so that display cards can be slid free from the rungs of any face of any upright.

2. The apparatus of claim 1 wherein the central upright is essentially square in cross-section and has four faces and wherein there are four side uprights.

3. The apparatus of claim 1 wherein each side upright has two essentially parallel faces and two vertical sides.

4. The apparatus of claim 1 wherein the central upright is rotatably mounted and means are provided to rotate the central upright and the side uprights.

5. The apparatus of claim 1 wherein (a) the central upright is essentially square in cross-section and has four vertical faces and four vertical corners; (b) there are four side uprights, each having two essentially parallel faces and first and second vertical sides, each side upright's first vertical side having a vertical stop member to prevent display cards from being slid past the stop member off the rungs of the side upright; and (c) each side upright in its first position has its second vertical side sufficiently close to one of the four vertical corners to prevent any merchandise cards from being slid free from the rungs of any of the uprights.

6. The apparatus of claim 1 having locking means for locking the side uprights in their first positions to hinder unauthorized removal of the display cards from the apparatus.

7. Apparatus for displaying merchandise mounted on display cards generally "C"-shaped in cross-section having an upper channel and a bottom channel, the bottom channel being wider than the upper channel, said apparatus comprising:

(a) a vertical rotatably mounted central upright essentially square in horizontal cross-section having four faces and four vertical corners, each face having at least one pair of upper and lower rungs of different widths that can mesh, respectively, with the upper and lower channels of a display card so that the card can be removed easily from the rungs only by sliding it free from the rungs in a direction essentially parallel to the length of the rungs;

(b) four vertical rotatably mounted side uprights each having two essentially parallel faces and first and second vertical sides, each face having at least one pair of rungs of different widths that can mesh, respectively, with the upper and lower channels of a display card so that the card can be removed easily from the rungs only by sliding it from the rungs in a direction essentially parallel to the length of the rungs, each first vertical side having a stop member to prevent display cards from being slid past the stop member off the rungs of the side upright;

(c) means for rotating the center upright and the four side uprights each from its first position to its second position, the second vertical side of each side upright being sufficiently close to a different one of the four vertical corners of the central upright when all five uprights are in their first positions so that display cards cannot be slid free from the rungs of any face of any upright and the second vertical sides of the side uprights being sufficiently distant from the vertical corners of the central upright when all five uprights are in their second positions so that display cards can be slid free from the rungs of any face of any upright; and (d) means for locking the five uprights in their first positions to hinder unauthorized removal of the display cards from the apparatus.

8. The apparatus of claim 7 wherein the means for rotating the five uprights comprises a gear system having a master gear meshed with four slave gears, one slave gear for each side upright.

9. The apparatus of claim 8 wherein the means for locking the five uprights in their first positions comprises a spring-loaded pin that must be removed from a socket to permit rotation of the master gear.

10. A method for displaying merchandise mounted on display cards generally "C"-shaped in cross-section having an upper channel and a bottom channel, one channel being wider than the other channel, said method comprising interlocking the channels of the display cards with the rungs of the apparatus of any of claims 1 to 9.

* * * * *